US009741511B2

(12) United States Patent
Fukushima et al.

(10) Patent No.: US 9,741,511 B2
(45) Date of Patent: Aug. 22, 2017

(54) ROTARY OPERATION TYPE ELECTRONIC COMPONENT

(71) Applicant: TOKYO COSMOS ELECTRIC CO., LTD., Kanagawa (JP)

(72) Inventors: Hajime Fukushima, Kanagawa (JP); Satomi Nakamura, Kanagawa (JP)

(73) Assignee: TOKYO COSMOS ELECTRIC CO., LTD., Kanagawa (JP)

( * ) Notice: Subject to any disclaimer, the term of this patent is extended or adjusted under 35 U.S.C. 154(b) by 6 days.

(21) Appl. No.: 14/773,035

(22) PCT Filed: Jun. 7, 2013

(86) PCT No.: PCT/JP2013/065894

§ 371 (c)(1),
(2) Date: Sep. 4, 2015

(87) PCT Pub. No.: WO2014/196086

PCT Pub. Date: Dec. 11, 2014

(65) Prior Publication Data

US 2016/0020044 A1 Jan. 21, 2016

(51) Int. Cl.
*H01H 19/11* (2006.01)
*H01H 19/14* (2006.01)
(Continued)

(52) U.S. Cl.
CPC ..... *H01H 19/14* (2013.01); *H01H 19/11* (2013.01); *H01H 11/00* (2013.01); *H01H 19/58* (2013.01); *H01H 19/64* (2013.01)

(58) Field of Classification Search
CPC ..... H01H 19/11; H01H 19/14; H01H 19/64; H01H 25/06; H01H 19/58
(Continued)

(56) References Cited

U.S. PATENT DOCUMENTS 4,719,324 A 1/1988 Kuratani
6,043,855 A * 3/2000 Grave ..... G02F 1/133308 349/58
(Continued)

FOREIGN PATENT DOCUMENTS

CN 1236965 12/1999
CN 201430041 3/2010
(Continued)

OTHER PUBLICATIONS

Office Action issued in Japan Counterpart Patent Appl. No. 2012-100650, dated Oct. 4, 2016 , along with an english translation thereof.
(Continued)

*Primary Examiner* — Edwin A. Leon
*Assistant Examiner* — Ahmed Saeed
(74) *Attorney, Agent, or Firm* — Greenblum & Bernstein, P.L.C.

(57) ABSTRACT

A technology for making the heat load on an electronic component attached to a target object smaller than before is provided. The electronic component includes a main body, the main body including an electronic component unit adapted to generate an electrical signal and click feeling in accordance with rotation of an engaged portion, a shaft support having a cylindrical portion to be inserted into a through-hole formed in the target object, and a retaining member; and a control shaft made of metal and capable of rotating the engaged portion, the control shaft being inserted into the cylindrical portion after a reflow soldering process of the target object is completed, and being engaged with the engaged portion. The control shaft inserted into the cylindrical portion is retained by the retaining member.

12 Claims, 13 Drawing Sheets

(51) Int. Cl.
*H01H 19/58* (2006.01)
*H01H 19/64* (2006.01)
*H01H 11/00* (2006.01)

(58) Field of Classification Search
USPC ..... 200/336, 11 R
See application file for complete search history.

(56) References Cited

U.S. PATENT DOCUMENTS

| | | | | |
|---|---|---|---|---|
| 7,109,430 | B2 * | 9/2006 | Horton | H01H 19/11 200/296 |
| 2009/0178904 | A1 | 7/2009 | Nielsen et al. | |
| 2010/0294632 | A1 | 11/2010 | Reddering et al. | |
| 2012/0000758 | A1 | 1/2012 | Fukushima et al. | |
| 2012/0006659 | A1 | 1/2012 | Fukushima et al. | |

FOREIGN PATENT DOCUMENTS

| | | |
|---|---|---|
| CN | 202049890 | 11/2011 |
| CN | 202332678 | 7/2012 |
| CN | 202678133 | 1/2013 |
| JP | 53-80576 | 7/1978 |
| JP | 62-91405 | 6/1987 |
| JP | 01-160511 | 11/1989 |
| JP | 2001-250705 | 9/2001 |
| JP | 2007-311153 | 11/2007 |
| JP | 2008-530741 | 8/2008 |
| JP | 2010-218883 | 9/2010 |
| JP | 2011-159562 | 8/2011 |
| JP | 2012-221654 | 11/2012 |
| TW | 201103061 | 1/2011 |
| TW | 201135786 | 10/2011 |
| WO | 2010/092910 | 8/2010 |
| WO | 2010/106891 | 9/2010 |

OTHER PUBLICATIONS

Office Action issued in Taiwan Counterpart Patent Appl. No. 102120515, dated Sep. 5, 2016 , along with an english translation thereof.
Official Action, along with English-language translation thereof, for CN Appl. No. 201380075244.X dated Aug. 24, 2016.
Official Action, with English-language translation, for JP App. No. 2012-100650 having a mailing date of Jun. 9, 2015.
Official Action, with English-language translation, for JP App. No. 2012-100650 having a mailing date of Jul. 21, 2015.
International Search Report, with English-language translation, for PCT/JP2013/065894 having a mailing date of Jul. 9, 2013.
Official Action, along with English language translation thereof, in CN Appl. No. 201380075244.X dated Apr. 17, 2017.

* cited by examiner

ROTARY OPERATION TYPE ELECTRONIC COMPONENT

TECHNICAL FIELD

The present invention relates to a rotary operation type electronic component which causes a switch to be opened or closed or causes a resistance value to be varied, by rotation of a control shaft.

BACKGROUND ART

Conventionally known rotary operation type electronic components include the rotary operation type electronic components disclosed in Japanese Patent Application Laid Open No. 2011-159562 (patent literature 1) and Japanese Patent Application Laid Open No. 2010-218883 (patent literature 2), for example. These rotary operation type electronic components have a control shaft made of metal.

To reduce the number of assembly steps, a target object on which the rotary operation type electronic component is mounted, such as a printed circuit board, is often subjected to a reflow soldering process.

The reflow soldering process has been conventionally performed on the target object with the rotary operation type electronic component having a metal control shaft attached to it.

PRIOR ART LITERATURE

Patent Literature

Patent literature 1: Japanese Patent Application Laid Open No. 2011-159562

Patent literature 2: Japanese Patent Application Laid Open No. 2010-218883

SUMMARY OF THE INVENTION

Problems to be Solved by the Invention

However, if the reflow soldering process is performed on the target object after the rotary operation type electronic component having a metal control shaft is attached to the target object, since the metal control shaft absorbs heat, the temperature of the reflow soldering process should be raised. Alternatively, the duration of the reflow soldering process should be extended. However, this would increase the heat load on the electronic component attached to the target object.

An object of the present invention is to provide such a rotary operation type electronic component that the heat load on the electronic component attached to the target object becomes smaller than before.

Means to Solve the Problems

In one aspect of the present invention, a rotary operation type electronic component includes a main body, the main body including an electronic component unit adapted to generate an electrical signal and click feeling in accordance with rotation of an engaged portion, a shaft support having a cylindrical portion to be inserted into a through-hole formed in a target object, and a retaining member; and a control shaft made of metal and capable of rotating the engaged portion, the control shaft being inserted into the cylindrical portion after a reflow soldering process of the target object is completed, and being engaged with the engaged portion. The control shaft inserted into the cylindrical portion is retained by the retaining member.

Effects of the Invention

The control shaft is attached after the reflow soldering process of the target object is completed. Since the reflow soldering process is performed on the target object while the metal control shaft, which would absorb heat, is not present, the temperature of the reflow soldering can be made lower than before. In addition, the duration of the reflow soldering process can be made shorter than before. Consequently, the heat load on the electronic component attached to the target object can be made smaller than before.

DETAILED DESCRIPTION OF THE EMBODIMENTS

Now, an embodiment of a rotary operation type electronic component according to the present invention will be described.

The rotary operation type electronic component includes a main body 1 and a control shaft 2.

Figure 1:
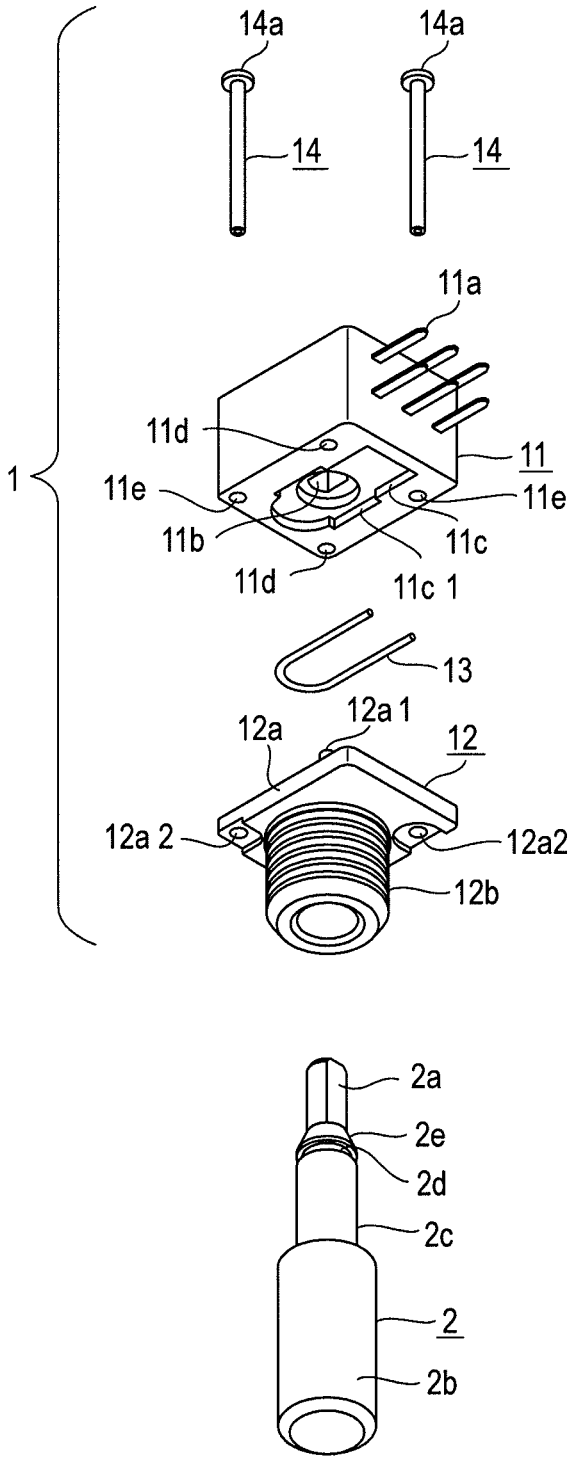
FIG. 1 is an exploded perspective view of a rotary operation type electronic component.
Figure 2:
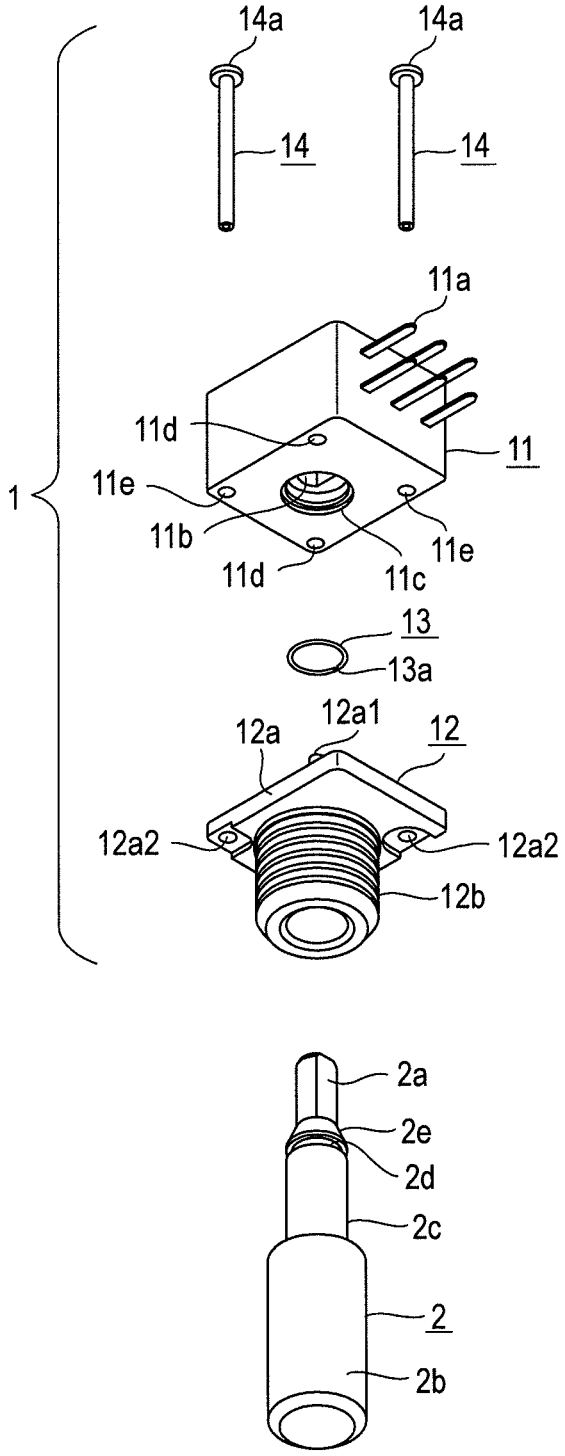
FIG. 2 is an exploded perspective view of another rotary operation type electronic component.

The main body 1 includes an electronic component unit 11, a shaft support 12, a retaining member 13, and rivets 14, as shown in FIG. 1. The components of the main body 1 will be described next.

Figure 3:
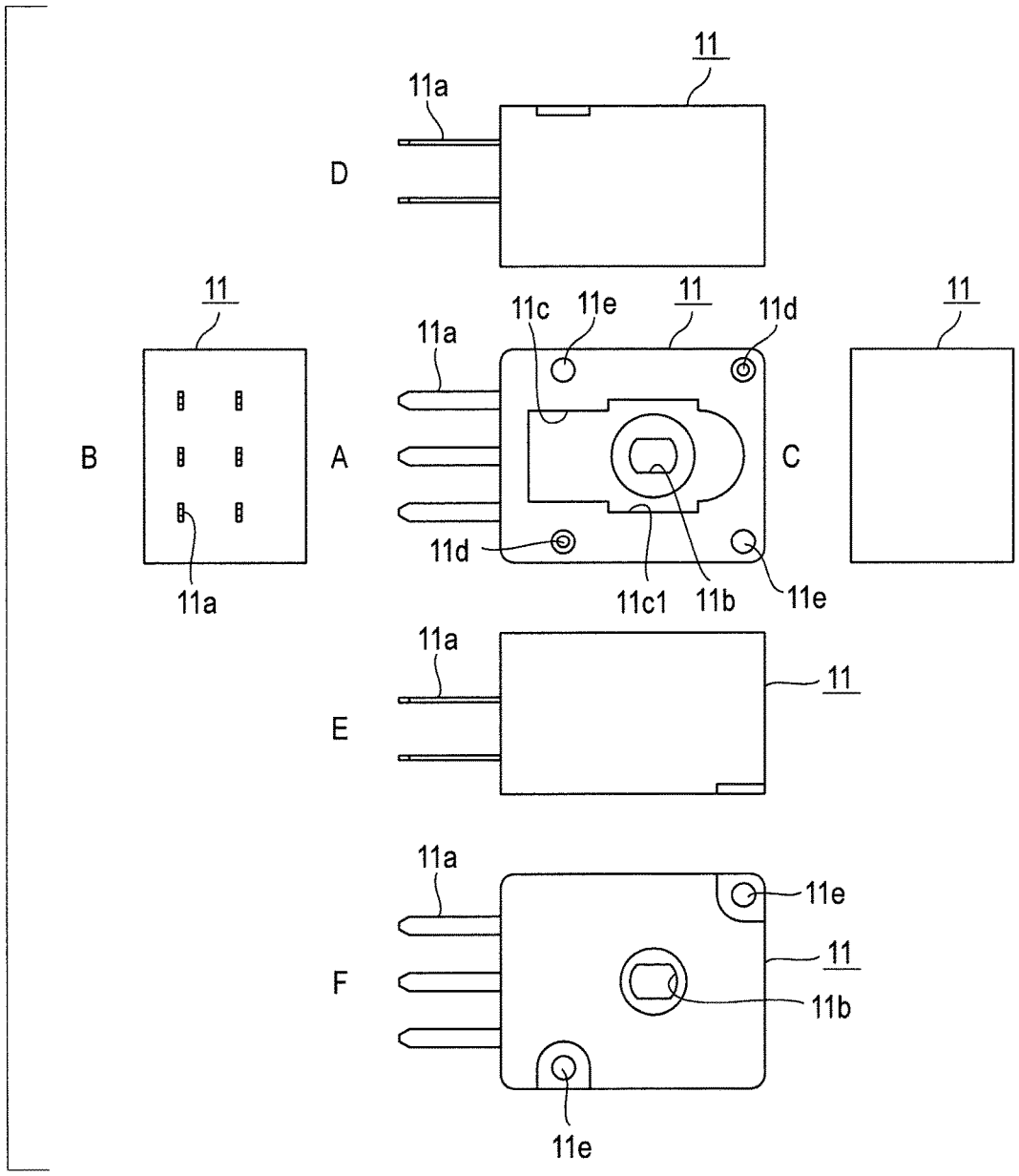
FIG. 3A is a front view of a main body.
FIG. 3B is a left side view of the main body.
FIG. 3C is a right side view of the main body.
FIG. 3D is a plan view of the main body.
FIG. 3E is a bottom view of the main body.
FIG. 3F is a back view of the main body.

The electronic component unit 11 has a rectangular parallelepiped shape as shown in FIG. 3. Six terminals 11*a* for inputting and outputting an electrical signal are disposed on one of the six faces of the terminal 11. An engaged portion 11*b* is disposed inside the electronic component unit 11. The engaged portion 11*b* has two opposite face portions facing each other.

The electronic component unit 11 generates an electrical signal and click feeling in accordance with rotation of the engaged portion 11*b*. So long as it generates an electrical signal and click feeling in accordance with rotation of the engaged portion 11*b*, the electronic component unit 11 can be any type of electronic component and can have any configuration. For example, the electronic component unit 11 may be a switch which turns on or off an electrical signal and may also be a variable resistor which varies its resistance in accordance with the rotation of the engaged portion 11*b*. For specific example configurations of the electronic component unit 11, refer to patent literature 1 and 2.

A groove 11*c* shaped to receive the retaining member 13 is formed in a face of the electronic component unit 11 opposite to the shaft support 12. The retaining member 13 is placed in the groove 11*c*. In the example of the electronic component unit 11 shown in FIG. 3, the groove 11*c* is bell-shaped. The groove 11*c* has wide portions 11*c*1, where the retaining member 13 placed in the groove 11*c* can be spread wider when the control shaft 2 is inserted.

The electronic component unit 11 has depressed portions 11*d* and through-holes 11*e* at its four corners.

Figure 5:
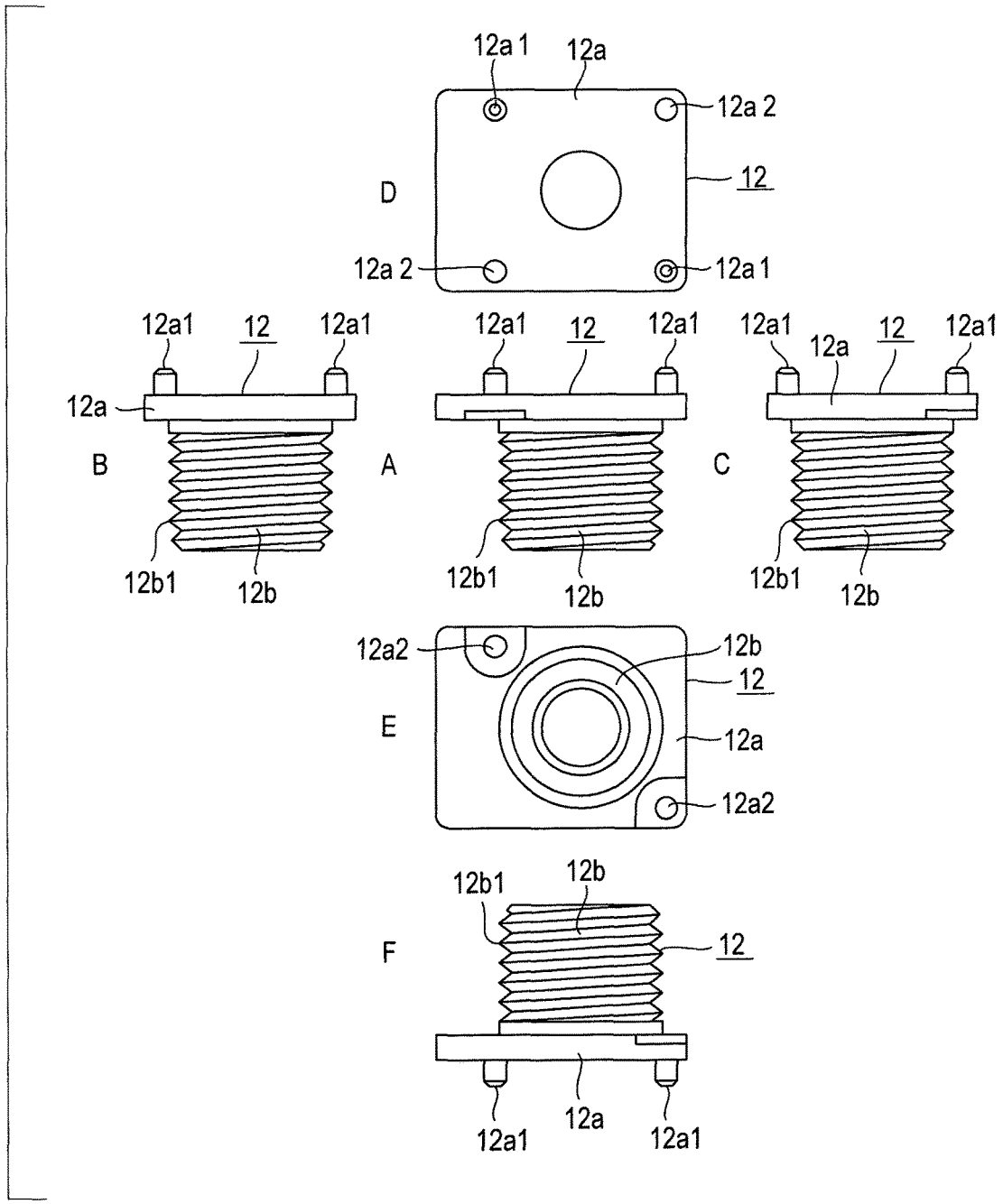
FIG. 5A is a front view of a shaft support.
FIG. 5B is a left side view of the shaft support.
FIG. 5C is a right side view of the shaft support.
FIG. 5D is a plan view of the shaft support.
FIG. 5E is a bottom view of the shaft support.
FIG. 5F is a back view of the shaft support.

The shaft support 12 includes a rectangular plate portion 12*a* and a cylindrical portion 12*b* disposed at a center of the plate portion 12*a*, as shown in FIG. 5. An external thread 12*b*1 is formed on the outer periphery of the cylindrical portion 12*b*. A through-hole is formed inside the cylindrical portion 12*b* and the plate portion 12*a*. The plate portion 12*a* has projecting portions 12*a*1 and through-holes 12*a*2 at its four corners. The shaft support 12 is made of resin or metal.

Figure 6:
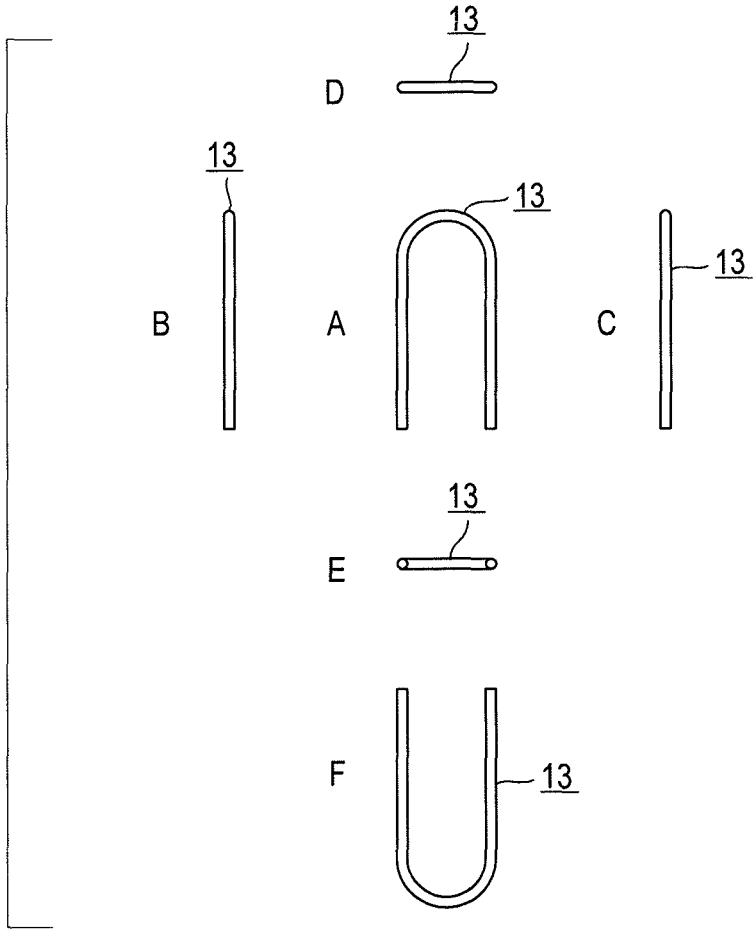
FIG. 6A is a front view of a retaining member.
FIG. 6B is a left side view of the retaining member.
FIG. 6C is a right side view of the retaining member.
FIG. 6D is a plan view of the retaining member.
FIG. 6E is a bottom view of the retaining member.
FIG. 6F is a back view of the retaining member.

The retaining member 13 is a U-shaped spring, as shown in FIG. 6.

Figure 8:
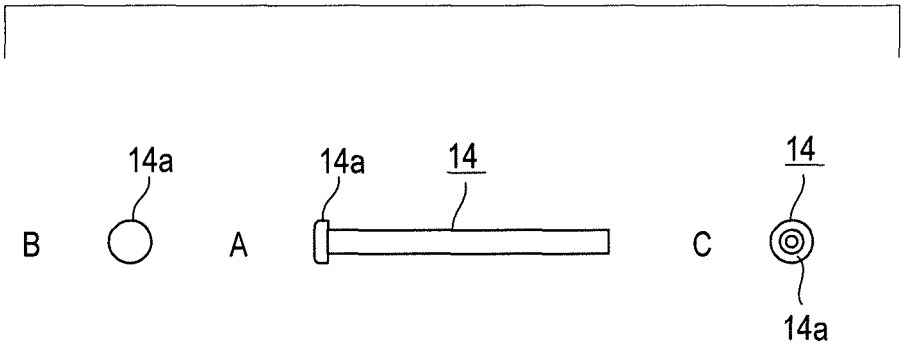
FIG. 8A is a front view of a rivet.
FIG. 8B is a left side view of the rivet.
FIG. 8C is a right side view of the rivet.
Figure 9:
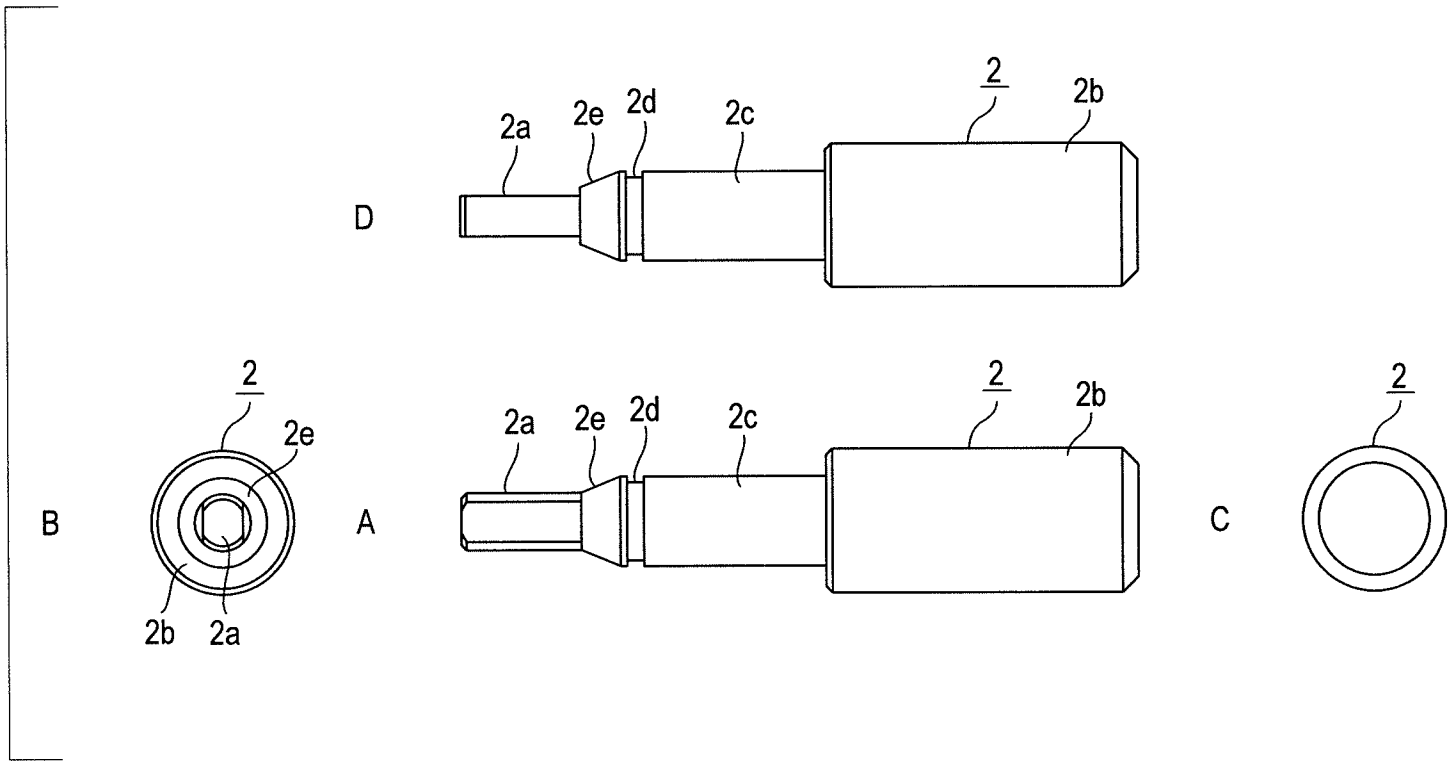
FIG. 9A is a front view of a control shaft.
FIG. 9B is a left side view of the control shaft.
FIG. 9C is a right side view of the control shaft.
FIG. 9D is a plan view of the control shaft.

The rivets 14 are stick-shaped as shown in FIG. 8 and have a flange 14*a* formed at one end. The rivets 14 are made of aluminum, for example.

The retaining member 13 is placed in the groove 11*c* of the electronic component unit 11, and in that state, the projecting portions 12*a*1 of the shaft support 12 are put into the depressed portions 11*d* of the electronic component unit 11, to connect the shaft support 12 and the electronic component unit 11 together. While the shaft support 12 and the electronic component unit 11 are coupled to each other, the rivets 14 are inserted into the through-holes 11*e* of the electronic component unit 11 and the through-holes 12*a*2 of the shaft support 12, and the ends of the inserted rivets 14 are caulked. Then, the shaft support 12 and the electronic component unit 11 are integrally secured.

The control shaft 2 is bar-shaped and is made of metal. The control shaft 2 has an engaging portion 2*a* at one end and a control portion 2*b* at the other end. The engaging portion 2*a* is shaped to fit the engaged portion 11*b* of the electronic component unit 11. In the example shown, the engaging portion 2*a* has parallel face portions formed to be 180 degrees apart by cutting two parts off the outer periphery of a column. A slide face portion 2*c* having a smaller diameter than the control portion 2*b* is disposed at a middle of the control shaft 2. When the control shaft 2 is inserted into the shaft support 12, the slide face portion 2*c* comes into contact with the inner periphery of the through-hole formed inside the cylindrical portion 12*b*. Rotation of the control shaft 2 in that state causes the slide face portion 2*c* to slide on the inner periphery of the through-hole formed inside the cylindrical portion 12*b*. Disposed between the slide face portion 2*c* and the engaging portion 2*a* are a groove 2*d* having a smaller diameter than the slide face portion 2*c* and a tapered portion 2*e* whose diameter decreases gradually toward the engaging portion 2*a*. The diameter of the largest-diameter portion of the tapered portion 2*e* is larger than the diameter of the groove 2*d*.

When the rotary operation type electronic component is mounted to a target object 3, first, just the main body 1 is attached to the target object 3. In an example illustrated in FIG. 10 and FIG. 13, the main body 1 is attached to the target object 3 by inserting the cylindrical portion 12*b* of the shaft support 12 into a through-hole 3*a* formed in the target object 3 and tightening a nut 4 on the external thread 12*b*1 formed on the outer periphery of the cylindrical portion 12*b*. The terminals 11*a* of the electronic component unit 11 are connected to a printed circuit board, not shown, of the target object 3. In that state, the target object 3 and the main body 1 are both subjected to reflow soldering.

Figure 11:
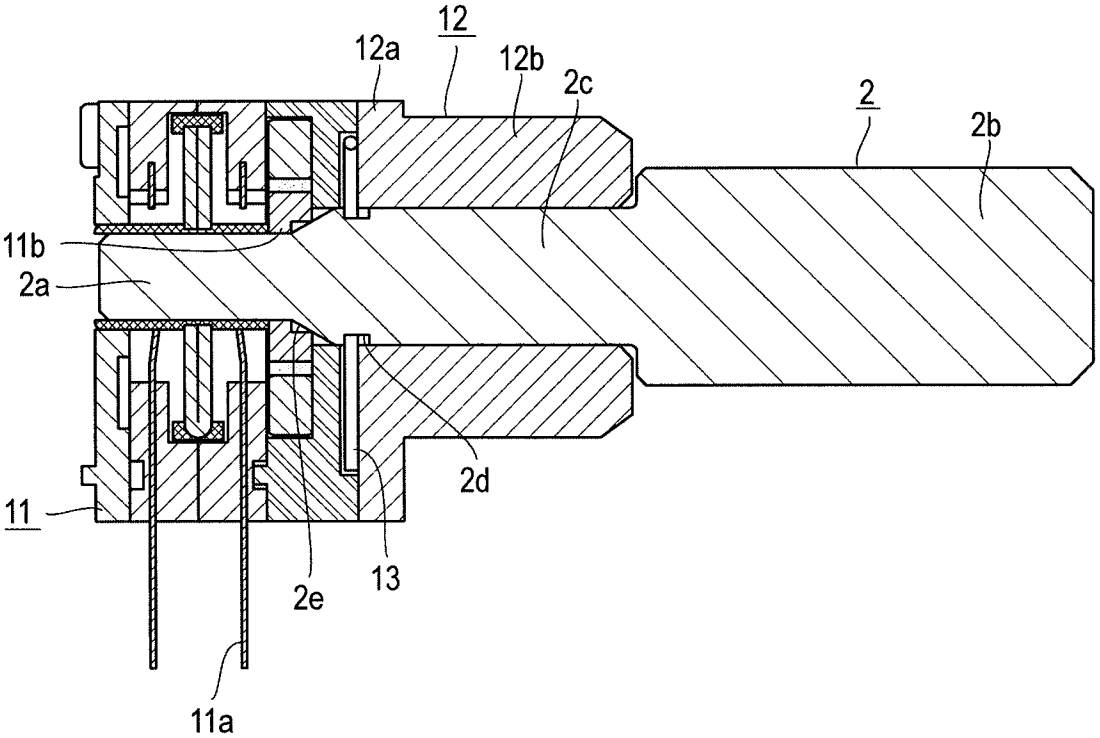
FIG. 11 is a sectional view showing a state in which the control shaft is inserted into the main body.

The control shaft 2 is then inserted into the cylindrical portion 12*b* of the main body 1. When the control shaft 2 is inserted into the cylindrical portion 12*b*, the tapered portion 2*e* meets the retaining member 13 first. When the control shaft 2 is inserted further, the increasing diameter of the tapered portion 2*e* spreads out the retaining member 13. The spread retaining member 13 finally returns to its original shape in the groove 2*d* of the control shaft 2 and fits into the groove 2*d*. This prevents the control shaft 2 from coming out of the main body 1. The engaging portion 2*a* of the control shaft 2 engages with the engaged portion 11*b* of the electronic component unit 11. FIG. 11 shows a sectional view of a state in which the control shaft 2 is inserted into the main body 1. In FIG. 11, the target object 3 and the nut 4 are omitted.

Rotary operation of the control shaft 2 causes the engaging portion 2*a* of the control shaft 2 to rotate the engaged portion 11*b*. The electronic component unit 11 generates an electrical signal and click feeling in accordance with the rotation of the engaged portion 11*b*.

The control shaft 2 is attached after the reflow soldering process of the target object 3 is completed. Since the reflow soldering process of the target object 3 is carried out while the metal control shaft 2, which would absorb heat, is not present, the temperature of the reflow soldering process can be made lower than before. In addition, the duration of the reflow soldering process can be made shorter than before. Consequently, the heat load on the electronic component attached to the target object 3 can be made smaller than before.

Figure 10:
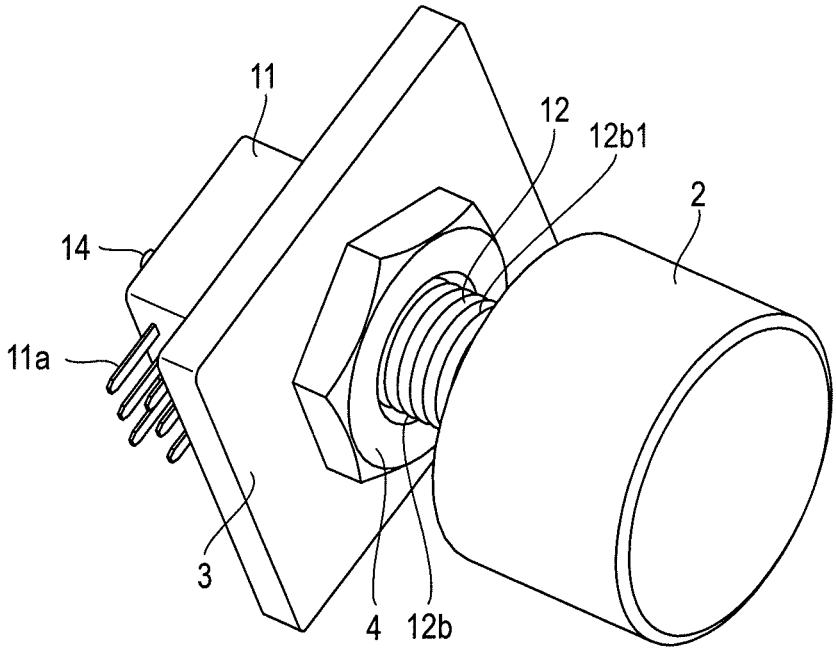
FIG. 10 is a perspective view showing a state in which the rotary operation type electronic component is attached to a target object.
Figure 13:
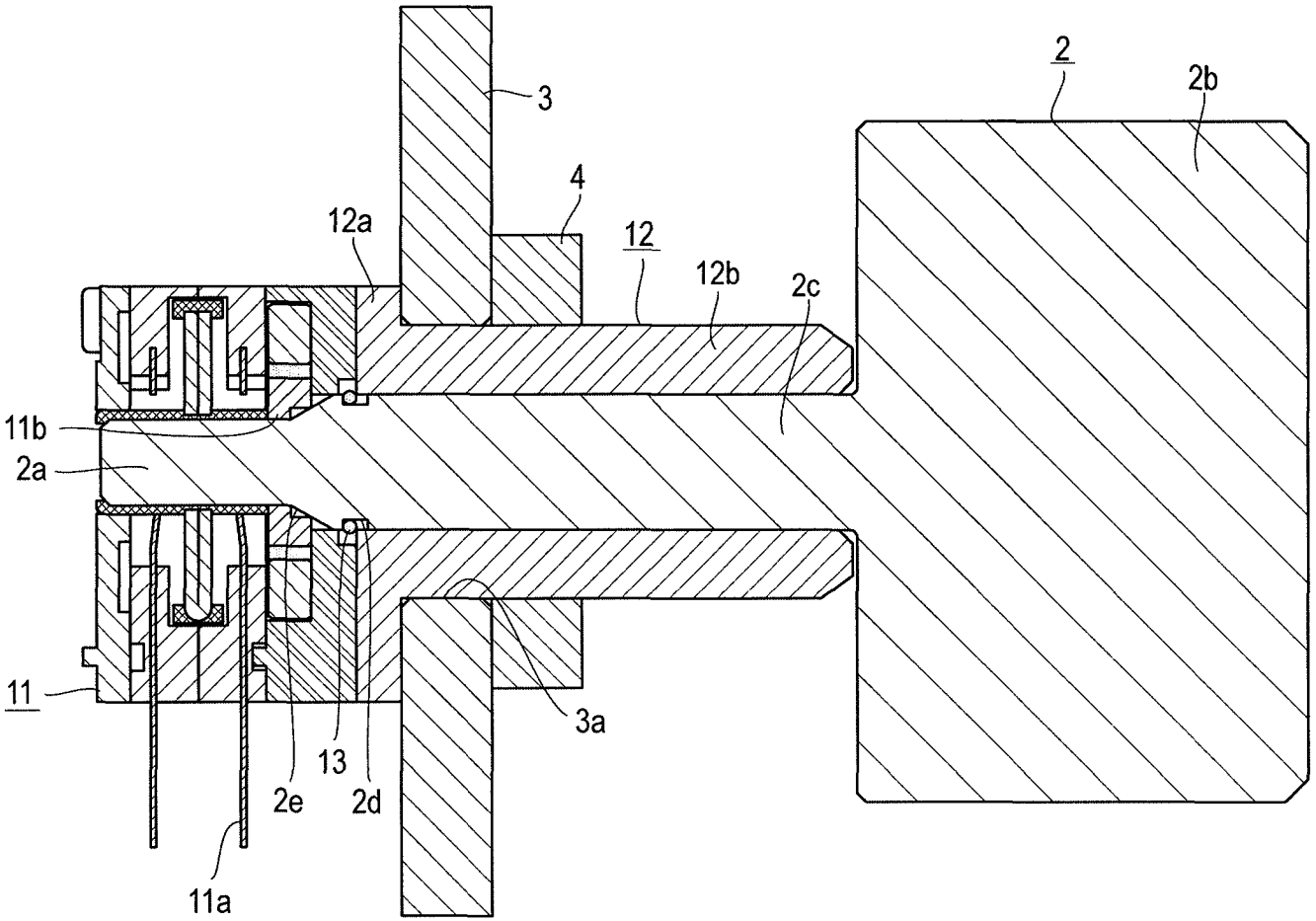
FIG. 13 is a sectional view showing the state in which the rotary operation type electronic component is attached to the target object.

Since the control shaft 2 is inserted after the cylindrical portion 12*b* is inserted into the through-hole 3*a* formed in the target object 3, the diameter of the control portion 2*b* of the control shaft 2 can be larger than the diameter of the through-hole 3*a*. In other words, the diameter of the control portion 2*b* of the control shaft 2 can be larger than the diameter of the cylindrical portion 12*b*. FIG. 10 and FIG. 13 show a rotary operation type electronic component in which the diameter of the control portion 2*b* of the control shaft 2 is larger than the diameter of the through-hole 3*a* or the diameter of the cylindrical portion 12*b*.

Figure 4:
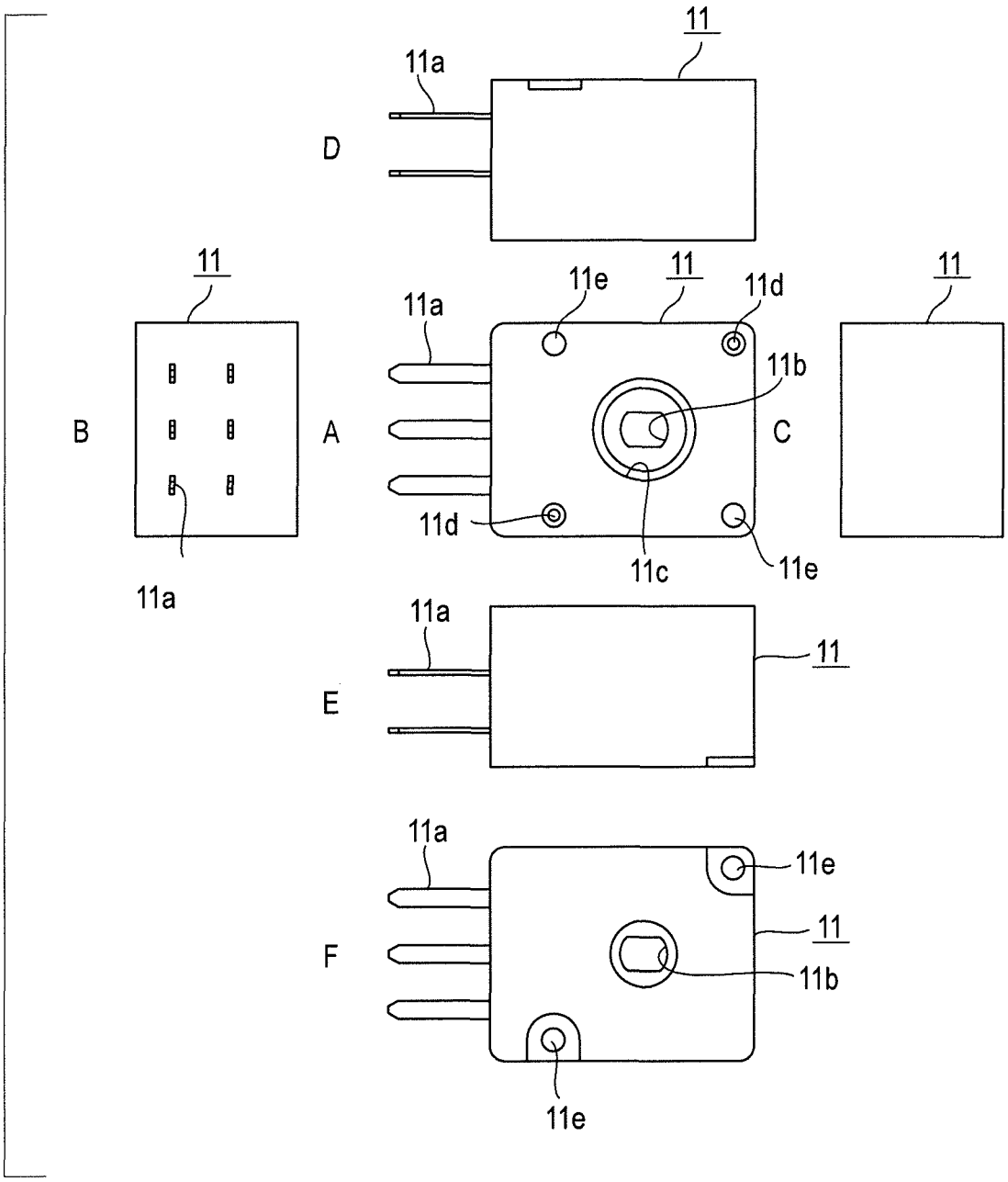
FIG. 4A is a front view of another main body.
FIG. 4B is a left side view of the main body.
FIG. 4C is a right side view of the main body.
FIG. 4D is a plan view of the main body.
FIG. 4E is a bottom view of the main body.
FIG. 4F is a back view of the main body.
Figure 7:
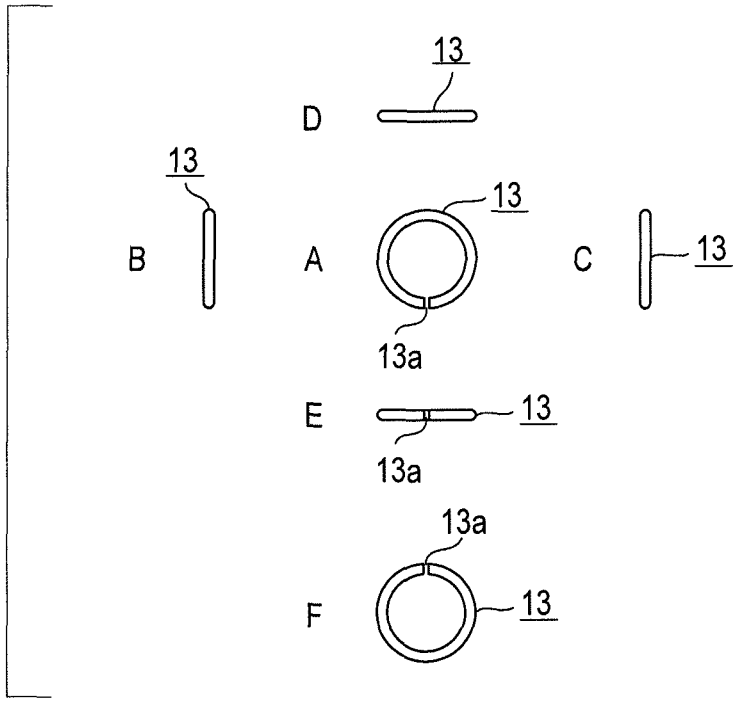
FIG. 7A is a front view of another retaining member.
FIG. 7B is a left side view of the retaining member.
FIG. 7C is a right side view of the retaining member.
FIG. 7D is a plan view of the retaining member.
FIG. 7E is a bottom view of the retaining member.
FIG. 7F is a back view of the retaining member.
Figure 12:
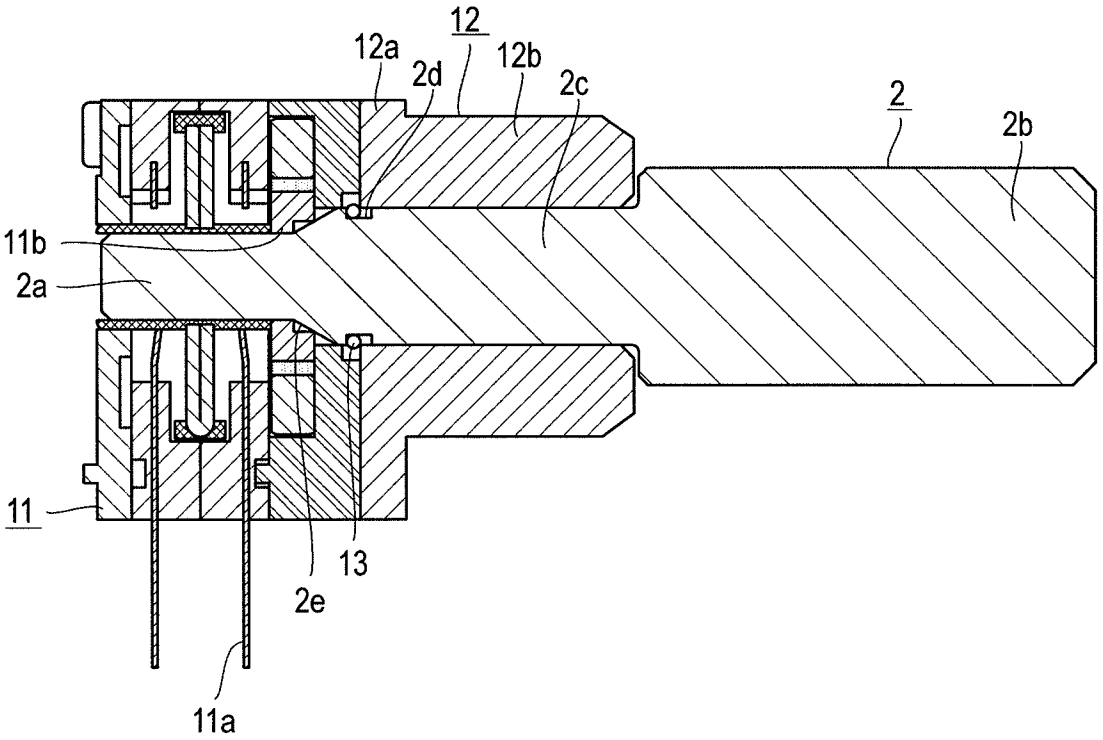
FIG. 12 is a sectional view showing a state in which the control shaft is inserted into the other main body.

The shape of the retaining member 13 is not limited to the U-shape shown in FIG. 6. The retaining member 13 may have a C-shape, which is a ring shape with a gap 13*a*, as shown in FIG. 7. In that case, the groove 11*c* of the electronic component unit 11 should be circular, as shown in FIG. 4. FIG. 12 shows a sectional view of a state in which the control shaft 2 is inserted into the main body 1 having a C-shaped retaining member 13. In FIG. 12, the target object 3 and the nut 4 are omitted.

The groove 11*c* into which the retaining member 13 is fitted is formed in the electronic component unit 11 in the examples shown in FIG. 3 and FIG. 4. However, the groove 11*c* may be formed in the shaft support 12. Moreover, the retaining member 13 may be disposed in any position of the main body 1. For example, the position may be inside the main body 1 or may be inside the shaft support 12.

The outer periphery of the cylindrical portion 12*b* does not need to have the external thread 12*b*1. Such a cylindrical portion 12*b* is just inserted into the through-hole 3*a* of the target object 3 and is not tightened with the nut 4.

The present invention is not limited to the embodiment described above, and changes can be made within the scope of the present invention.

DESCRIPTION OF REFERENCE NUMERALS

1 main body
11 electronic component unit
11*b* engaged portion
12 shaft support
12*b* cylindrical portion
13 retaining member
2 control shaft
3 target object
4 nut

What is claimed is:

1. A rotary operation electronic component comprising:
a main body comprising:
an electronic component configured to generate an electrical signal and a click feeling in accordance with rotation of an engaged portion;
a shaft support having a cylindrical portion configured to be inserted into a through-hole provided in a target object; and
a retaining member;
a control shaft comprised of metal and that is configured to rotate the engaged portion; and
a groove shaped to receive the retaining member that is provided in the electronic component or the shaft support, wherein
the retaining member is provided in and secured to the groove by being directly sandwiched between a bottom of the electronic component and a top of the shaft support,
the control shaft is inserted into the cylindrical portion after completion of a reflow soldering process of the target object,
the control shaft is engaged with the engaged portion, and
the control shaft is retained by the retaining member.

2. The rotary operation electronic component according to claim 1, wherein
the control shaft is inserted into the cylindrical portion after the cylindrical portion is inserted into the through-hole and after the reflow soldering process of the target object is completed, and
the control shaft is larger than the through-hole.

3. The rotary operation electronic component according to claim 1, wherein
an external thread is provided on an outer periphery of the cylindrical portion, and
the rotary operation electronic component is secured to the target object by a nut tightened on the external thread after the cylindrical portion is inserted into the through-hole.

4. The rotary operation electronic component according to claim 3, wherein the retaining member is C-shaped.

5. The rotary operation electronic component according to claim 3, wherein the retaining member is U-shaped.

6. The rotary operation electronic component according to claim 2, wherein the retaining member is C-shaped.

7. The rotary operation electronic component according to claim 2, wherein the retaining member is U-shaped.

8. The rotary operation electronic component according to claim 2, wherein
an external thread is provided on an outer periphery of the cylindrical portion, and
the rotary operation electronic component is secured to the target object by a nut tightened on the external thread after the cylindrical portion is inserted into the through-hole.

9. The rotary operation electronic component according to claim 8, wherein the retaining member is C-shaped.

10. The rotary operation electronic component according to claim 8, wherein the retaining member is U-shaped.

11. The rotary operation electronic component according to claim 1, wherein the retaining member is C-shaped.

12. The rotary operation electronic component according to claim 1, wherein the retaining member is U-shaped.

* * * * *